US007419536B2

(12) United States Patent
Aiba et al.

(10) Patent No.: US 7,419,536 B2
(45) **Date of Patent: *Sep. 2, 2008**

(54) ELECTROLESS GOLD PLATING LIQUID

(75) Inventors: Akihiro Aiba, Kitaibaraki (JP); Yoshiyuki Hisumi, Kitaibaraki (JP); Kazumi Kawamura, Kitaibaraki (JP)

(73) Assignee: Nikko Materials Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/558,173

(22) PCT Filed: Feb. 18, 2004

(86) PCT No.: PCT/JP2004/001784

§ 371 (c)(1),
(2), (4) Date: Nov. 22, 2005

(87) PCT Pub. No.: WO2004/108987

PCT Pub. Date: Dec. 16, 2004

(65) Prior Publication Data

US 2006/0230979 A1 Oct. 19, 2006

(30) Foreign Application Priority Data

Jun. 5, 2003 (JP) ..... 2003-160974

(51) Int. Cl.
*C23C 18/31* (2006.01)

(52) U.S. Cl. ..... 106/1.23; 106/1.26

(58) Field of Classification Search ..... 106/1.23, 106/1.26; 428/457
See application file for complete search history.

(56) References Cited

U.S. PATENT DOCUMENTS

| | | | | |
|---|---|---|---|---|
| 3,300,328 | A * | 1/1967 | Luce | 106/1.26 |
| 5,232,492 | A * | 8/1993 | Krulik et al. | 106/1.23 |
| 6,787,233 | B1 * | 9/2004 | Molteberg et al. | 428/403 |
| 2006/0269761 | A1 * | 11/2006 | Aiba et al. | 428/457 |

FOREIGN PATENT DOCUMENTS

| | | |
|---|---|---|
| JP | 8-291389 | 11/1996 |
| JP | 10-130855 | 5/1998 |
| JP | 10-317157 | 12/1998 |
| JP | 3 030 113 | 2/2000 |
| JP | 2002-273239 | 9/2002 |
| JP | 2003-13249 | 1/2003 |

* cited by examiner

*Primary Examiner*—Helene Klemanski
(74) *Attorney, Agent, or Firm*—Flynn, Thiel, Boutell & Tanis, P.C.

(57) ABSTRACT

There is provided a cyanide-free immersion type electroless gold plating liquid that is low in toxicity, can be used near a neutral ph, and has a good solder adhesion and plating film adhesion. The electroless gold plating liquid contains a cyanide-free water-soluble gold compound and a pyrosulfurous acid compound. The plating liquid may further contain a sulfurous acid compound and an aminocarboxylic acid compound. Pyrosulfurous acid or an alkali metal, alkaline earth metal, ammonium, or another such salt thereof can be used as the pyrosulfurous acid compound.

5 Claims, 2 Drawing Sheets

ELECTROLESS GOLD PLATING LIQUID

TECHNICAL FIELD

This invention relates to a plating technique, and particularly relates to a cyanide-free immersion type electroless gold plating liquid.

BACKGROUND ART

Immersion type electroless gold plating liquids have been used to form an intermediate layer in an effort to improve the solder adhesion of circuits, terminals, and so forth in printed wiring boards, and to improve the adhesion of reductive gold plating and the like. Most of the gold plating liquids used for this purpose contain a toxic cyanide compound as a gold compound, but concerns for environment and workplace require cyanide-free gold plating liquids that do not contain toxic substances.

Patent applications that have been filed for cyanide-free substitutional gold plating liquids include those that make use of gold sulfite compounds (see, for example, Japanese Patent No. 3,030,113 and Japanese Patent Publication No. 2003-13249), those that make use of a salt of gold sulfites or chloroaurates (see, for example, Japanese Patent Publication No. H8-291389), and those that make use of gold sulfite, gold chloride, gold thiosulfate, or gold mercaptocarboxylates (see, for example, Japanese Patent Publication No. H10-317157). The electroless gold plating liquids discussed in these are cyanide-free and therefore low in toxicity, and can be used close to neutral. But, a problem is their inferior solder adhesion and plating film adhesion. "Plating film adhesion" refers to the adhesion between an immersion type electroless gold plating film and the substrate and, when an immersion type electroless gold plating film is used as an intermediate layer, refers to the adhesion between the layers above and below the film.

DISCLOSURE OF THE INVENTION

In light of the above situation, it is an object of the present invention to provide a cyanide-free immersion type electroless gold plating liquid that is low in toxicity, can be used near neutral, and brings good solder adhesion and plating film adhesion.

As a result of researching what adversely affects the plating film adhesion and solder adhesion of an immersion type electroless gold plating film, the inventors found that the problem is non-uniform substitution with the underlying metal plating film, such as an underlying nickel film. More specifically, solder adhesion and plating film adhesion were poor in the case that non-uniform corrosion marks such as pitting were seen on an underlying nickel film after a gold plating film had been stripped off, because defects of some kind were also present in an immersion type electroless gold plating film. Conversely, whenever there were no non-uniform corrosion marks to be seen, the solder adhesion and plating film adhesion were good.

Therefore, the inventors researched bath compositions that would not result in non-uniform corrosion marks in the underlying nickel film after stripping the gold off, and as a result discovered that it is effective to add a pyrosulfurous acid compound, which enables a gold plating film to have good solder adhesion and plating film adhesion. Many patent applications have been filed for cyanide-free immersion type electroless gold plating liquids as mentioned above, but none of them contains a pyrosulfurous acid compound.

Specifically, the present invention is as follows.

(1) An electroless gold plating liquid, containing a cyanide-free water soluble gold compound and a pyrosulfurous acid compound.

(2) A electroless gold plating liquid according to (1) above, further containing a sulfurous acid compound.

(3) A electroless gold plating liquid according to (1) or (2) above, further containing an aminocarboxylic acid compound.

(4) A gold plated article, produced using the electroless gold plating liquid according to any of (1) to (3) above.

There are no particular restrictions on the cyanide-free water-soluble gold compound used in the plating liquid of the present invention, as long as it is cyanide-free and water-soluble, but it is characterized by containing a pyrosulfurous acid compound as an additive.

BEST MODE FOR CARRYING OUT THE INVENTION

Figure 1:
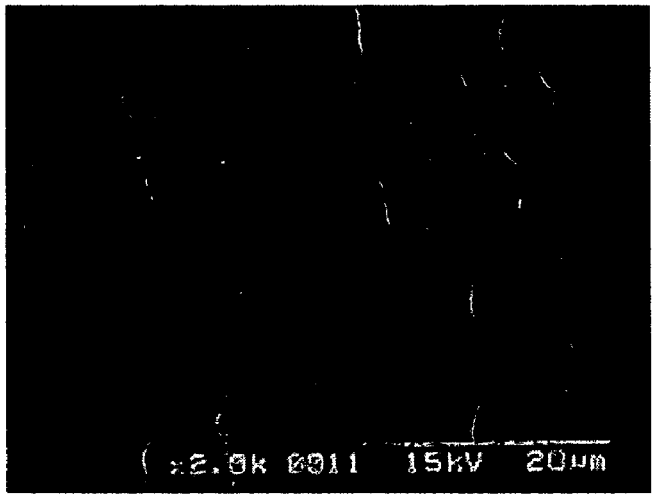
FIG. 1 is an SEM micrograph of an underlying nickel plating film after stripping a gold plating film off in Example 1.

The electroless gold plating liquid of the present invention will now be described in detail.

The electroless gold plating liquid of the present invention is prepared by dissolving a cyanide-free water-soluble gold compound and a pyrosulfurous acid compound in water. There are no particular restrictions on the cyanide-free water-soluble gold compound as long as it is a gold compound and cyanide-free, but it is preferable to use gold sulfite, gold thiosulfate, gold thiocyanate, chloroauric acid, or a salt of these. The electroless gold plating liquid of the present invention preferably contains these gold compounds in an amount of 0.1 to 100 g/L, and more preferably 0.5 to 20 g/L, as the gold concentration in the plating liquid. Substitution of gold will occur much more slowly if the gold concentration is less than 0.1 g/L, but there will be no further advantage to exceeding 100 g/L.

The pyrosulfurous acid compound can be pyrosulfurous acid or an alkali metal, alkaline earth metal, ammonium, or other such salt thereof. The pyrosulfurous acid compound is preferably contained in the plating liquid in an amount of 0.1 to 200 g/L, and more preferably 1 to 100 g/L. The effect of preventing non-uniform corrosion of the underlying nickel will be weak if the pyrosulfurous acid concentration is less than 0.1 g/L, but there will be no further advantage to exceeding 200 g/L.

The electroless gold plating liquid of the present invention preferably contains a sulfurous acid compound as a stabilizer. Examples of this sulfurous acid compound include sulfurous acid and alkali metal, alkaline earth metal, ammonium, and other such salts thereof. The concentration of the sulfurous acid compound in the plating liquid is preferably from 0.1 to 200 g/L, and more preferably 1 to 100 g/L. The compound will have no effect as a stabilizer if the concentration is less than 0.1 g/L, but there will be no further advantage to exceeding 200 g/L.

The plating liquid of the present invention may further contain an aminocarboxylic acid compound as a complexing agent. Examples of aminocarboxylic acid compounds include ethylenediaminetetraacetic acid, hydroxyethylethylenediaminetriacetic acid, dihydroxyethylethylenediaminediacetic acid, propanediaminetetraacetic acid, diethylenetriamine pentaacetic acid, triethylenetetraminehexaacetic acid, glycine, glycylglycine, glycylglycylglycine, dihydroxyethylglycine, iminodiacetic acid, hydroxyethyliminodiacetic acid, nitrilotriacetic acid, nitrilotripropionic acid, and alkali metal, alkaline earth metal, ammonium, and other such salts of these. The concentration of the aminocarboxylic acid compound in the plating liquid is preferably from 0.1 to 200 g/L, and more preferably 1 to 100 g/L. The effect as a complexing agent will be weak if the aminocarboxylic acid compound concentration is less than 0.1 g/L, but there will be no further advantage to exceeding 200 g/L.

A phosphoric acid compound may also be added as needed as a pH buffer to the electroless gold plating liquid of the present invention.

Examples of phosphoric acid compounds include phosphoric acid, pyrophosphoric acid or alkali metal, alkaline earth metal, and ammonium salts of these, alkali metal dihydrogenphosphates, alkaline earth metal dihydrogenphosphates, ammonium dihydrogenphosphates, di-alkali metal hydrogenphosphates, di-alkaline earth metal hydrogenphosphates, and diammonium hydrogenphosphates. The concentration of the phosphoric acid compound in the plating liquid is preferably from 0.1 to 200 g/L, and more preferably 1 to 100 g/L.

It is preferable to use one of the above-mentioned compounds as a pH buffer and adjust the pH of the gold plating liquid of the present invention to be between 4 and 10, and more preferable to adjust to be a pH of from 5 to 9.

The gold plating liquid of the present invention is preferably used at a bath temperature of 10 to 95° C., and more preferably 50 to 85° C.

If the pH or bath temperature of the plating liquid is outside the ranges given above, there will be problems that the plating rate is slow, or bath decomposition is more apt to occur.

A gold plating film produced by use of the gold plating liquid of the present invention after a printed wiring board has been nickel-plated as an underlay for example, has good solder adhesion and plating film adhesion because there is no non-uniform substitution with the underlying nickel plating film. No non-uniform corrosion mark is seen in the underlying nickel film after the gold plating film has been stripped away.

EXAMPLES

Preferred embodiments of the present invention will now be described through the following Examples and Comparative Examples.

Examples 1 and 2 and Comparative Examples 1 and 2

Plating liquids of the various compositions shown in Table 1 were prepared as the immersion type electroless gold plating liquids. The material to be plated was a copper-clad printed wiring board with a resist opening diameter of 0.4 mmϕ, and plating was performed by the following process.

acidic degreasing (45° C., 5 min)

→soft etching (25° C., 2 min)

→acid washing (25° C., 1 min)

→activator (KG-522, made by Nikko Metal Plating)

(25° C., pH <1.0, 5 min)

→acid washing (25° C., 1 min)

→electroless nickel plating (plating liquid: KG-530, made by Nikko Metal Plating) (88° C., pH 4.5, 30 min)

→immersion type electroless gold plating (using plating liquid and plating conditions listed in Table 1)

→reductive electroless gold plating (plating liquid: KG-560, made by Nikko Metal Plating) (70° C., pH 5.0, 30 min)

(A water rinsing step lasting 1 minute is inserted between all steps except acid washing→activator.)

Figure 2:
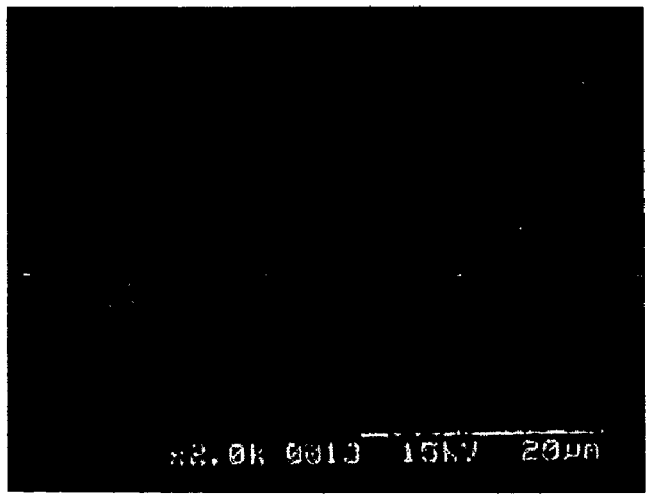
FIG. 2 is an SEM micrograph of an underlying nickel plating film after stripping a gold plating film off in Example 2.
Figure 3:
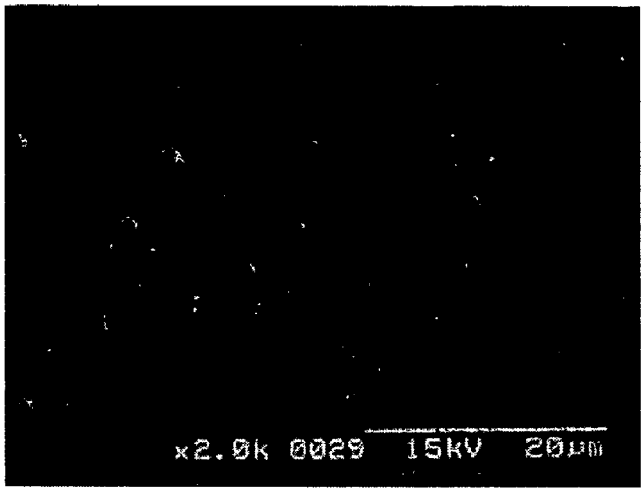
FIG. 3 is an SEM micrograph of an underlying nickel plating film after stripping a gold plating film off in Comparative Example 1.
Figure 4:
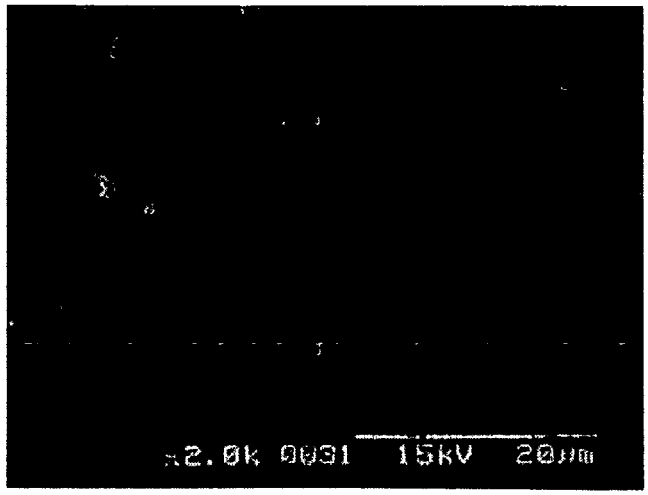
FIG. 4 is an SEM micrograph of an underlying nickel plating film after stripping a gold plating film off in Comparative Example 2.

The plated articles thus obtained were evaluated as follows. The state of corrosion of the underlying nickel plating film was observed at 2000-times magnification by SEM after the immersion type electroless gold plating film had been stripped off with Aurum Stripper 710 (25° C., 0.5 min), a gold stripper made by Nikko Metal Plating, and a check was performed by visual observation for corrosion marks (pitting). FIGS. 1 to 4 show SEM micrographs of the underlying nickel films after the gold plating films had been stripped away in Examples 1 and 2 and Comparative Examples 1 and 2, respectively. No pitting or no other non-uniform corrosion mark was seen in the underlying nickel plating films after stripping the gold plating films away in Examples 1 and 2, but pitting was observed in the underlying nickel plating films after stripping the gold plating films away in Comparative Examples 1 and 2.

Solder adhesive strength was measured as follows: the immersion type electroless gold plating had been performed; an Sn-37Pb solder ball with a diameter of 0.4 mm ϕ was placed on it, heated and bonded at a peak temperature of 240° C. in a reflow oven; then, the strength was measured with a series 4000 bond tester made by Deiji.

Plating film adhesion was evaluated as follows: the immersion type electroless gold plating was finished; the reductive electroless gold plating was performed; the plating was subjected to a tape peel test, and the plating was visually observed to check if any film had peeled off. This peel test involved applying a cellophane tape (Cellotape™ made by Nichiban) to the plating film, then peeling off the tape and visually checking to see if the plating film stuck to the tape.

The plating film thickness was measured with an SFT-3200 fluorescent X-ray film thickness gauge made by Seiko Denshi Kogyo.

The evaluation results are given in Table 1.

TABLE 1

| | | Example | | Comparative Example | |
|---|---|---|---|---|---|
| | | 1 | 2 | 1 | 2 |
| Bath composition | Gold compound | sodium gold sulfite: 1 g/L (gold) | sodium chloroaurate: 1 g/L (gold) | sodium gold sulfite: 1 g/L (gold) | potassium gold cyanide: 2 g/L (gold) |
| | Additive | sodium pyrosulfite: 5 g/L | sodium pyrosulfite: 10 g/L | — | — |
| | Stabilizer | sodium sulfite: 5 g/L | sodium sulfite: 10 g/L | sodium sulfite: 5 g/L | citric acid: 30 g/L |
| | Complexing agent | ethylenediamine tetraacetic acid: 10 g/L | nitrilo triacetic acid: 10 g/L | ethylenediamine tetraacetic acid: 10 g/L | ethylenediamine tetraacetic acid: 5 g/L |
| | pH buffer | sodium dihydrogen-phosphate: 30 g/L | sodium dihydrogen-phosphate: 30 g/L | sodium dihydrogen-phosphate: 30 g/L | — |
| Plating conditions | pH | 7.5 | 7.5 | 7.5 | 5.0 |
| | Plating temp. (° C.) | 80 | 80 | 80 | 90 |
| | Plating time (min) | 10 | 10 | 10 | 5 |
| Evaluation results | Film thickness (μm) | 0.05 | 0.05 | 0.05 | 0.05 |
| | Pitting | no | no | yes | yes |
| | Solder adhesive strength | 1412 | 1395 | 1046 | 1014 |
| | Plating film adhesion | no peeling | no peeling | peeled | peeled |

Solder adhesive strength units: gf (n = 20)

The present invention provides a cyanide-free immersion type electroless gold plating liquid that is low in toxicity, can be used near neutral, and brings good solder adhesion and plating film adhesion.

The invention claimed is:

1. In a substitutional electroless gold plating liquid for plating gold on a substrate by substitution with a metal in the substrate, the improvement comprising said gold plating liquid consisting essentially of a cyanide free water-soluble gold compound and a pyrosulfurous acid compound and, optionally, at least one of a sulfurous acid compound as a stabilizer and an aminocarboxylic acid compound as a complexing agent.

2. The substitutional electroless gold plating liquid of claim 1, further containing a sulfurous acid compound.

3. The substitutional electroless gold plating liquid of claim 1, further containing an aminocarboxylic acid compound.

4. The substitutional electroless gold plating liquid of claim 1, further containing a sulfurous acid compound and an aminocarboxylic acid compound.

5. The substitutional electroless gold plating liquid of claim 1, wherein the water-soluble gold compound is present in an amount of 0.5-20 g/L, as the gold concentration in the plating liquid.

* * * * *